US005839164A

United States Patent [19]

Cress et al.

[11] Patent Number: 5,839,164

[45] Date of Patent: Nov. 24, 1998

[54] CABINET HINGE WITH PRESS-IN MOUNTING CUP

[75] Inventors: David R. Cress, Janesville, Wis.; Stephen M. Purcell, Loves Park, Ill.

[73] Assignee: Newell Operating Company, Freeport, Ill.

[21] Appl. No.: 610,864

[22] Filed: Mar. 5, 1996

[51] Int. Cl.[6] ..... E05D 5/02

[52] U.S. Cl. ..... 16/383; 16/382; 16/384

[58] Field of Search ..... 16/383, 382, 272, 16264, 384, 237, 243; 403/292, 298

[56] References Cited

U.S. PATENT DOCUMENTS

| | | | |
|---|---|---|---|
| Re. 30,717 | 8/1981 | Dargene . | |
| 2,735,133 | 2/1956 | Hey et al. . | |
| 3,590,419 | 7/1971 | Dargene . | |
| 3,864,786 | 2/1975 | Salice . | |
| 4,050,116 | 9/1977 | Salice . | |
| 4,085,481 | 4/1978 | Lauten-schläger . | |
| 4,091,500 | 5/1978 | Lauten-schläger . | |
| 4,099,293 | 7/1978 | Pittasch . | |
| 4,159,557 | 7/1979 | Pittasch et al. . | |
| 4,185,357 | 1/1980 | Busse . | |
| 4,270,240 | 6/1981 | Zernig et al. . | |
| 4,506,409 | 3/1985 | Lauten-schläger . | |
| 4,517,706 | 5/1985 | Lauten-schläger et al. . | |
| 4,590,641 | 5/1986 | Lauten-schläger et al. . | |
| 4,615,072 | 10/1986 | Laüten-schläger, Jr. . | |
| 4,631,931 | 12/1986 | Schnelle | 16/383 |
| 4,641,393 | 2/1987 | Lauten-schläger . | |
| 4,642,846 | 2/1987 | Lauten-schlager . | |
| 4,653,144 | 3/1987 | Lauten-schläger, Jr. . | |
| 4,681,477 | 7/1987 | Fischer | 403/298 |
| 4,718,143 | 1/1988 | Lauten-schläger, Jr. . | |
| 4,799,290 | 1/1989 | Laüten-schläger, Jr. . | |
| 4,807,330 | 2/1989 | Gomes . | |
| 4,976,006 | 12/1990 | Lauten-schläger . | |
| 5,052,077 | 10/1991 | Lauten-schläger et al. . | |
| 5,144,721 | 9/1992 | Schade . | |
| 5,195,214 | 3/1993 | Lauten-schläger et al. . | |
| 5,233,726 | 8/1993 | Cress . | |
| 5,239,730 | 8/1993 | Grass . | |
| 5,271,670 | 12/1993 | Grabber . | |
| 5,327,616 | 7/1994 | Lauten-schläger . | |
| 5,347,687 | 9/1994 | Lauten-schläger . | |
| 5,355,557 | 10/1994 | Cress et al. . | |
| 5,375,297 | 12/1994 | Lauten-schläger et al. . | |
| 5,388,309 | 2/1995 | Grass . | |
| 5,406,677 | 4/1995 | Grass . | |
| 5,412,841 | 5/1995 | Lauten-schläger et al. . | |
| 5,454,144 | 10/1995 | Rupprechter . | |

FOREIGN PATENT DOCUMENTS

| | | | |
|---|---|---|---|
| 1784261 | 7/1968 | Germany | 16/383 |
| 1 559 900 | 3/1970 | Germany . | |
| 2421871 | 11/1975 | Germany | 16/384 |
| 2524503 | 12/1976 | Germany | 16/383 |
| 2821137 | 11/1979 | Germany | 16/382 |
| 3722950 | 1/1989 | Germany | 16/382 |
| 283666 | 10/1990 | Germany | 16/382 |

OTHER PUBLICATIONS

Photographs of an Amerock prototype invented by one of the applicants shown before the invention of the claimed subject matter (24 photographs labeled View 1 through View 24 on 12 sheets) related to U.S. Patent No. 5,233,726.

*Primary Examiner*—Daniel W. Howell
*Assistant Examiner*—Mark Williams
*Attorney, Agent, or Firm*—Foley & Lardner

[57] ABSTRACT

A hinge for mounting a door to a frame includes a mounting cup having an outer perimeter adapted for mounting within a recess formed in the door and a hinge member for being mounted to the frame and coupled to the mounting cup to allow selective pivotal movement of the door with respect to the frame. The mounting cup has an outer perimeter having a first portion with a first effective outer diameter and a second portion having a second effective outer diameter, the first outer diameter being larger than the second outer diameter, the first portion being adapted to provide an interference fit within the recess when the mounting cup is inserted into the recess. The first portion of the outer perimeter may be adapted to include at least one arcuate threaded section and at least one unthreaded section. The threaded sections may be removable segments that are coupled to the outer perimeter. The hinge may also include a compliant cup or ring that encircles at least partially the outer perimeter of the mounting cup.

20 Claims, 7 Drawing Sheets

FIG. 6
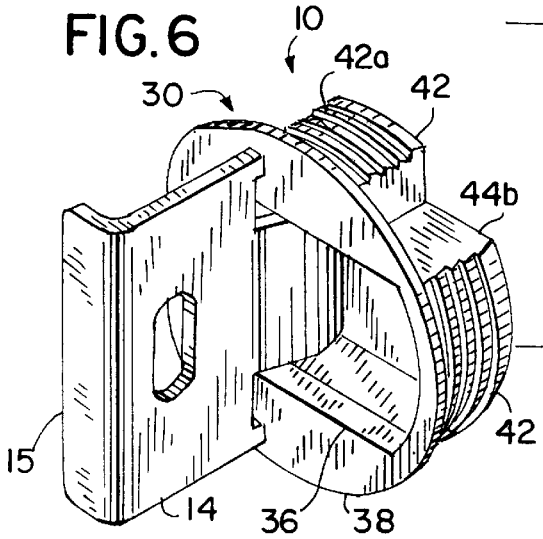
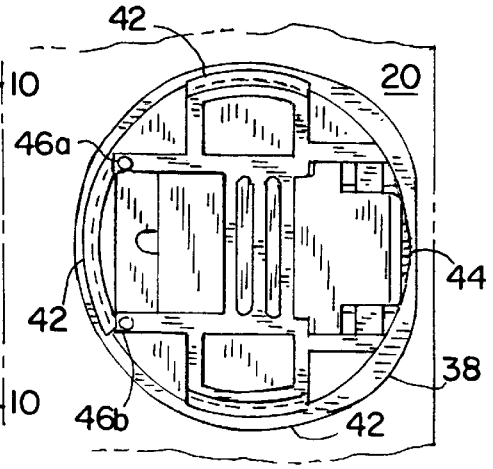
FIG. 7
FIG. 8
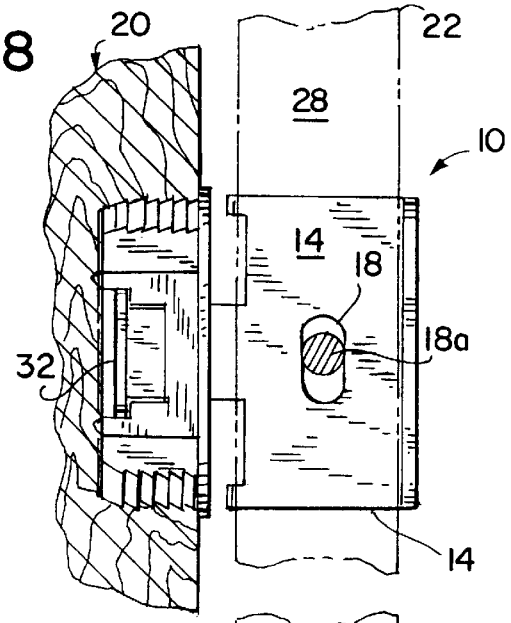
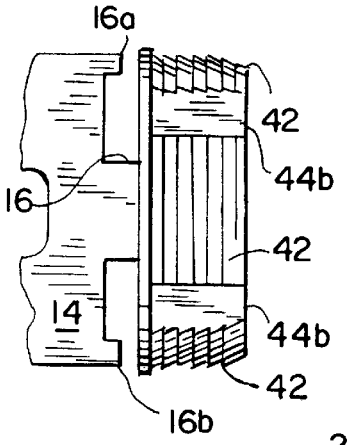
FIG. 10
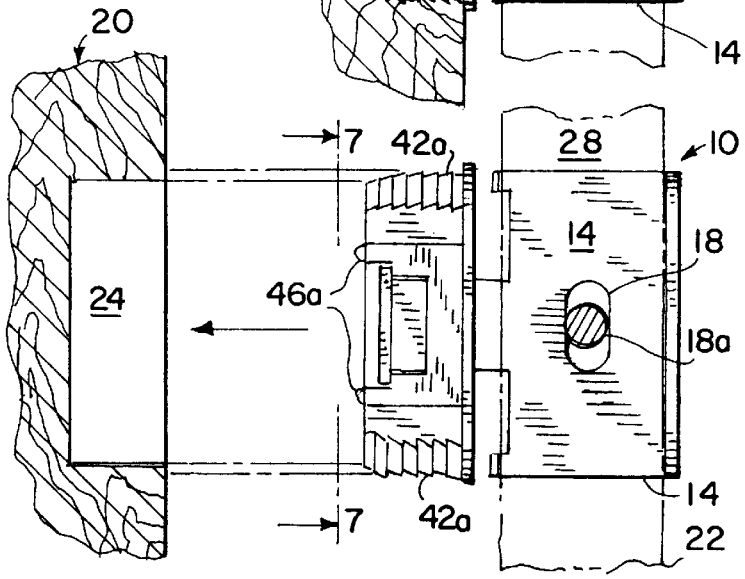
FIG. 9

FIG. 11
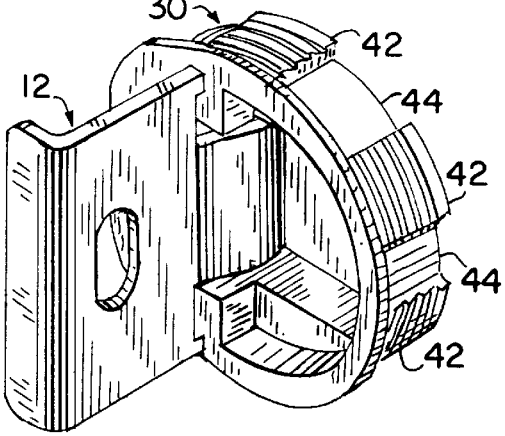
FIG. 12
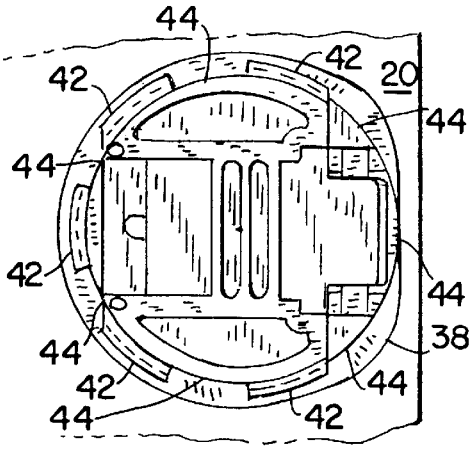
FIG. 13
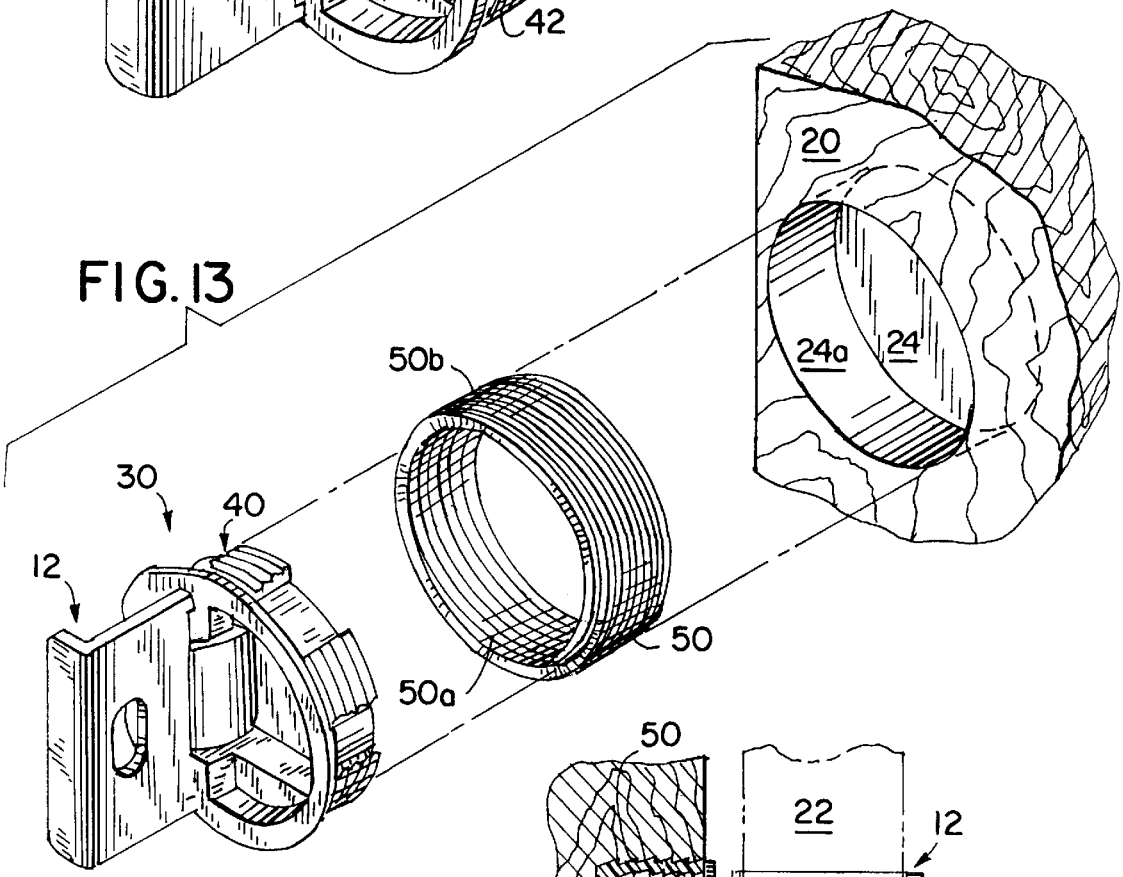
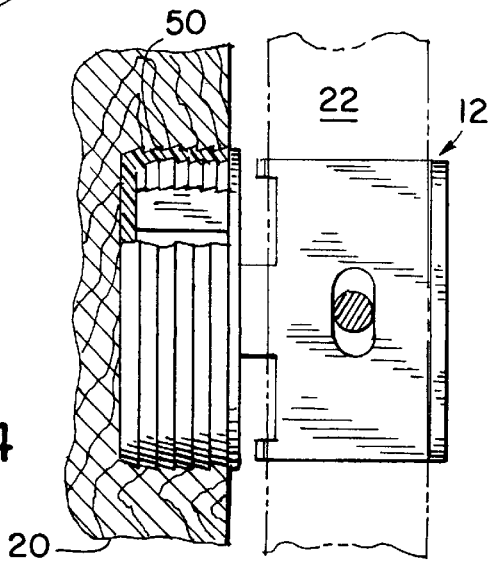
FIG. 14

FIG. 17
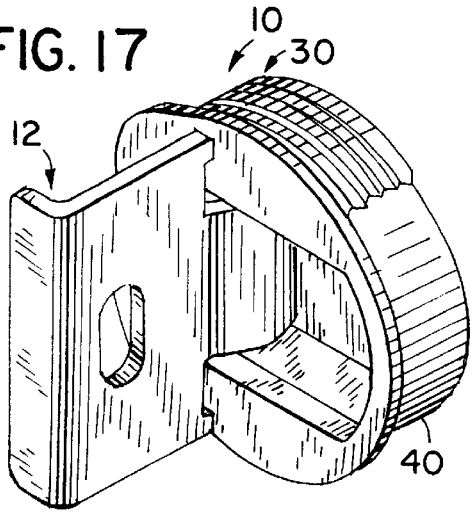
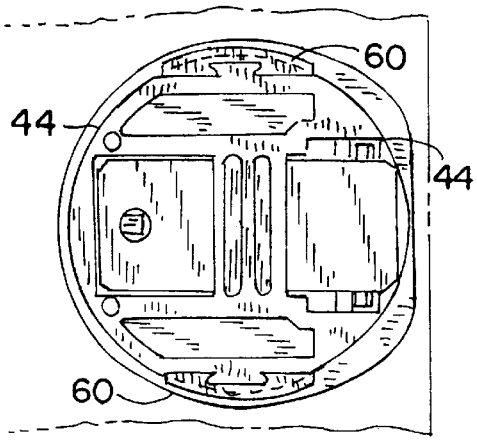
FIG. 18
FIG. 19
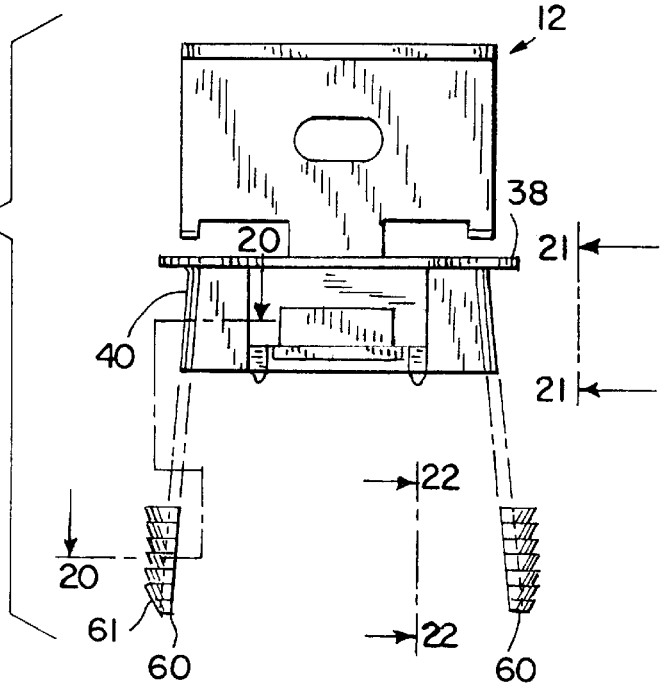
FIG. 20
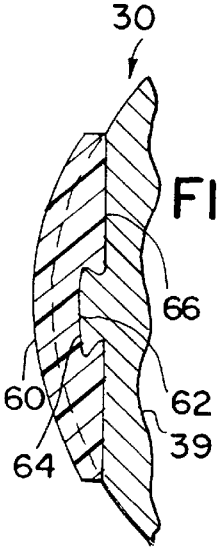
FIG. 21
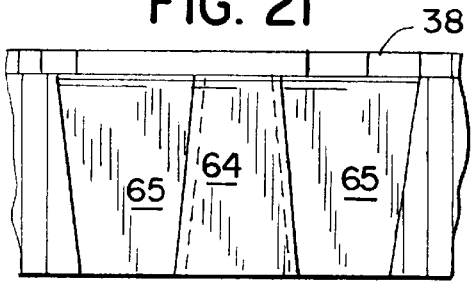
FIG. 22
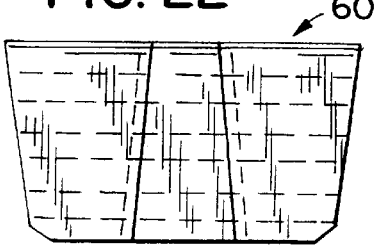

CABINET HINGE WITH PRESS-IN MOUNTING CUP

FIELD OF THE INVENTION

The present invention relates to a cabinet hinge used to mount a cabinet door to a frame. Specifically, the present invention relates to a cabinet hinge having a mounting cup with circumferential threads (or ribs) around the outer perimeter of the cup which is pressed into a cylindrical bore in the cabinet door. More specifically, the present invention relates to a press-in mounting cup wherein the circumferential threads (or ribs) are arranged around the outer perimeter of the cup in a plurality of discontinuous threaded (or ribbed) and unthreaded sections.

BACKGROUND OF THE INVENTION

Various arrangements are known for mounting a cabinet hinge to a cabinet door and mounting frame. In a common arrangement the cabinet hinge includes a mounting structure (such as a mounting plate) which is fastened to the cabinet door by one or more fasteners (such as mounting screws). Due to the number and type of fasteners which are typically required to ensure that the hinge is mounted securely enough to withstand the forces (e.g. "pull-out" and "bend-back") that it will be subjected to in use, this type of arrangement typically requires a relatively involved mounting process. This may affect the cost of manufacture, assembly and installation of the hinge. The use of a cabinet hinge with a press-in or rotary mounting cup for mounting a cabinet door to a mounting frame may (in some cases) serve to reduce cost by simplifying the overall design and installation process for the hinge (e.g. by reducing the total number of parts or fasteners).

Exemplary arrangements for mounting a cabinet hinge to a cabinet door by means of a rotary mounting cup have been disclosed in a number of issued U.S. patents. Some of these disclosed arrangements employ an anchoring relationship between the outer perimeter of the mounting cup and the cylindrical bore in the cabinet door into which the mounting cup is inserted. For example, U.S. Pat. No. 4,270,240 titled "Hinge Cup for Furniture Hinges," issued to Zernig et al. on Jun. 2, 1981 discloses a two-piece hinge cup formed with a cup section and a plastic anchoring part, the anchoring part receiving the cup section and in turn being received within a bore in a door. The anchoring part is secured in the bore by a series of circumferential anchoring ribs which develop anchoring forces between the hinge cup and the door material after insertion. The cup section itself is secured within the anchoring part by a series of projections with corresponding bores (holes) that receive the projections.

U.S. Pat. No. 4,091,500 entitled "Cabinet Hinge," issued to Lautenschläger on May 30, 1978 discloses a two-piece mounting arrangement with a cup-like (circular) external housing piece fastened into a matching (slightly undersized) mortise in a cabinet door and an insert piece (containing hinge links) that can be inserted and locked into a particular position within the housing piece. The housing piece is held in the mortise by circumferential spines or by sections which can be spread open to fasten the housing piece in the door. The insert piece is snap-fastened within the housing piece.

A press-in hinge cup assembly is also disclosed in U.S. Pat. No. 5,388,309 (entitled "Hinge with Rotary Cup") issued to Grass on Feb. 14, 1995. The assembly includes a press-in cup which is first inserted into a recess in the cabinet door and a rotary cup which is received within the hinge cup and rotated into place, safeguarded against unintentional disconnection by a double-locking detent system of resilient tongues and projections (bayonet-like connections).

Such conventional rotary and press-in mounting cups are commonly designed to be fit into a cylindrical bore in the wood cabinet door. Such rotary threaded press-in mounting cups may have a substantially continuous circumferential thread pattern covering (encircling) the substantial entirety of the outer perimeter of the cup. This rotary thread pattern may allow the cup, after it has been pressed into the cylindrical bore, to be removed from the bore (or recess) by "unthreading" (i.e. circular rotation of the cup with respect to the bore in a direction that outwardly displaces the cup from the bore). However, such substantially continuous thread patterns may present disadvantages during insertion and do not readily allow for design adjustment of the interference forces that must be overcome during insertion and that secure the cup within the bore.

Due to boring machine variations, cutter wear, and other variables such as type of wood, grain direction, and moisture content (e.g. caused by temperature and humidity), the size of the cylindrical bore in the cabinet door can vary by a relatively significant amount (e.g. 0.020 inches on the diameter). For example, with an increase in moisture content of the wood, the size of the bore can enlarge in the direction perpendicular to the wood grain and result in an unintended slightly oval or elliptical shape.

Due to these effects, it is desirable for a press-in mounting cup to have a relatively large amount of interference (caused by circumferential threads or ribs or other means) with the bore (which is slightly smaller in size than the cup) to ensure positive press-in mounting and secure retention. During insertion of the mounting cup this interference between the bore and the circumferential threads (or ribs) must be overcome with a relatively large press-in force, which may crack or split certain woods used in the cabinet door. Moreover, standard boring and insertion machines may not readily be capable of generating the press-in forces sufficient to ensure positive and complete insertion of the cup within the bore. While known rotary mounting cup arrangements using additional hardware to retain the cup in the bore may be designed to minimize press-in forces or to accommodate for variations in the size and shape of the bore, they may also be relatively complex to manufacture and install (e.g. requiring additional anchoring parts). Furthermore, these arrangements may not provide suitably secure or positive mounting for all applications.

Accordingly, it would be advantageous to have a cabinet hinge with a mounting cup of a relatively simple design having circumferential threads (or ribs) encircling at least a portion of the outer perimeter of the cup configured for relatively simple, secure and positive insertion of the cup within a bore formed in a door. It would be advantageous to have a cabinet hinge with a mounting cup that is configured for efficient press-in insertion, and for convenient removal (if necessary) by unthreading it from the bore within which it has been installed. It would also be advantageous to have a cabinet hinge with a mounting cup having an outer perimeter that can be arranged in a plurality of threaded (ribbed) and unthreaded sections as to adjust the press-in and pull-out (or bend-back) forces to desirable levels within a range. It would further be advantageous to have a cabinet hinge with a press-in mounting cup of a relatively simple design and of a relatively high strength, that is suitable for relatively low-cost manufacturing and installation.

SUMMARY OF THE INVENTION

The present invention features a hinge for mounting a door to a frame, which includes a mounting cup having an outer perimeter adapted for mounting within a recess formed in the door, and a hinge member for being mounted to the frame and coupled to the mounting cup to allow selective pivotal movement of the door with respect to the frame. The outer perimeter of the mounting cup includes a first portion having a first nominal outer diameter and a second portion having a second nominal outside diameter, the first nominal outer diameter being larger than the second nominal outside diameter, the first portion being adapted to provide an interference fit within the recess when the mounting cup is inserted into the recess, the interference fit to provide substantially all holding force between the hinge and the door.

The present invention also features a hinge for mounting a door to a frame, which includes a mounting cup having an outer perimeter adapted for mounting within a recess formed in the door, a hinge member for being mounted to the frame, and a hinge mechanism pivotally coupling the mounting cup to the hinge member to allow selective pivotal movement of the door with respect to the frame, where the outer perimeter of the mounting cup includes a first portion having a first nominal outer diameter and a second portion having a second nominal outside diameter, the first nominal outer diameter being larger than the second nominal outside diameter, the first portion being adapted to provide an interference fit within the recess when the mounting cup is inserted into the recess, the interference fit to provide substantially all holding force between the hinge and the door.

The present invention further features a hinge for mounting a door to a frame, which includes a mounting cup having an outer perimeter adapted for mounting within a recess formed in the door, a hinge member for being mounted to the frame and coupled to the mounting cup to allow selective pivotal movement of the door with respect to the frame, and collar means encircling at least partially the outer perimeter of the mounting cup for providing an interference fit within the recess when the mounting cup is pressed into the recess.

BRIEF DESCRIPTION OF THE FIGURES

FIG. 6 is a perspective view of a cabinet hinge according to an alternative embodiment;

FIG. 7 is a bottom plan view of the cabinet hinge shown in FIG. 6;

FIG. 8 is a side and cut-away view of the cabinet hinge of FIG. 6 when mounted in the cabinet door (shown in cut-away) and to the frame;

FIG. 9 is a side and cut-away view of the cabinet hinge of FIG. 6 before mounting in the cabinet door (shown in cut-away) and to the frame;

FIG. 10 is a side view of the cabinet hinge of FIG. 6 (with the hinge arm in cut-away view);

FIG. 11 is a perspective view of a cabinet hinge according to an alternative embodiment;

FIG. 12 is a bottom plan view of the cabinet hinge of FIG. 11;

FIG. 13 is an exploded perspective view of the cabinet hinge of FIG. 11 showing the installation into the cabinet door (shown in cut-away) with a compliant inner cup;

FIG. 14 is a side and cut-away view of the cabinet hinge of FIG. 11 (with the compliant inner cup) when mounted in the cabinet door (shown in cut-away) and to the frame;

FIG. 17 is a perspective view of a cabinet hinge according to an alternative embodiment showing a removable threaded wedge coupled to an outer perimeter of the mounting cup;

FIG. 18 is a bottom plan view of the cabinet hinge shown in FIG. 17;

FIG. 19 is a rotated side view of the cabinet hinge shown in FIG. 17 showing two removable threaded wedges removed from the outer perimeter of the mounting cup;

FIG. 20 is a sectional and cut-away view of the cabinet hinge of FIG. 17 showing a coupling of the removable threaded wedge with the outer perimeter of the mounting cup;

FIG. 21 is a sectional and end view of the cabinet hinge of FIG. 17 showing the outer perimeter of the mounting cup at the coupling to a removable threaded wedge;

FIG. 22 is a side view of the removable threaded wedge;

DETAILED DESCRIPTION OF PREFERRED EMBODIMENTS

Referring to the FIGURES, preferred and alternative embodiments of a concealed hinge with a press-in cup for mounting a cabinet door to a frame are shown. It should be noted at the outset that the press-in cup disclosed and claimed herein can be used with any suitable type of hinge arrangement, including concealed and unconcealed arrangements known to those skilled in the art.

Figure 1:
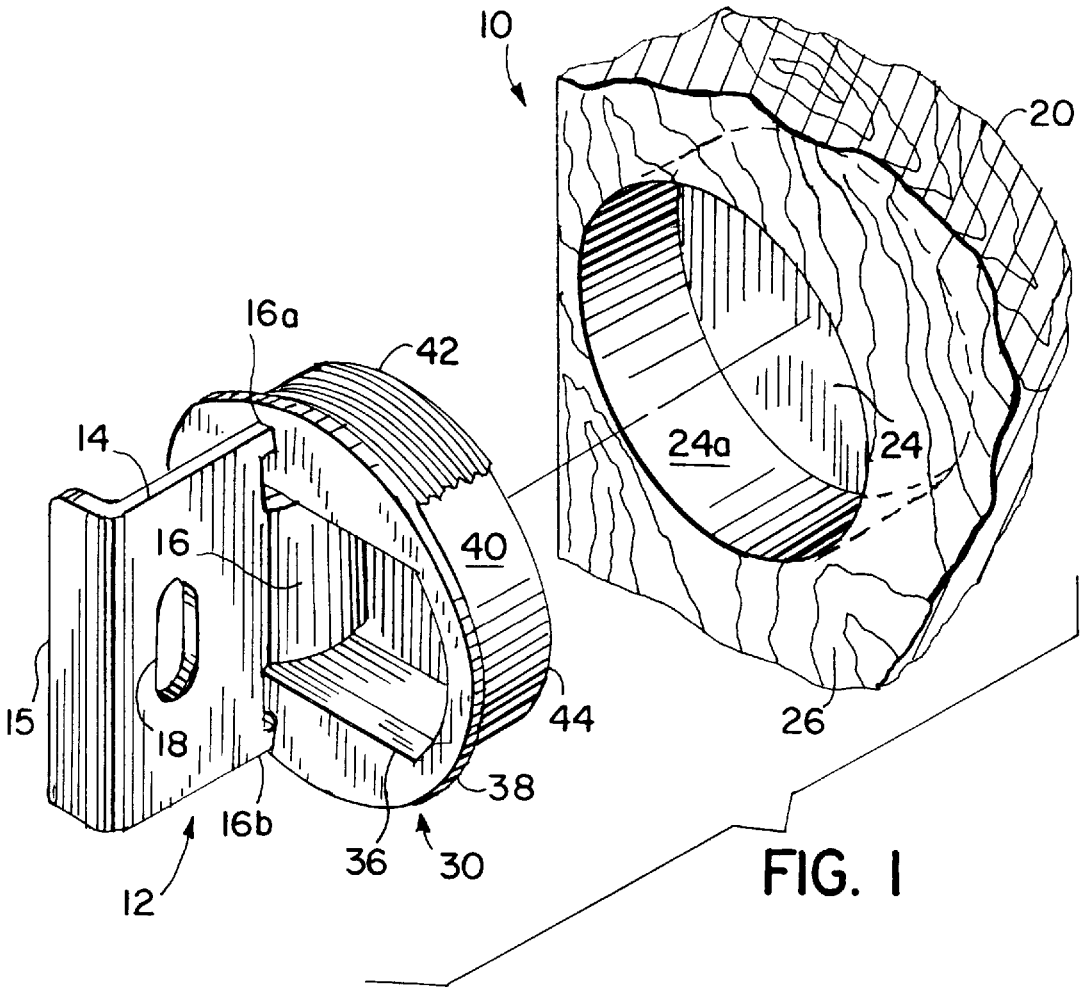
FIG. 1 is a perspective view of a cabinet hinge having a mounting cup and frame member coupled thereto according to a preferred embodiment showing an outer perimeter of the mounting cup and also showing (in cut-away view) a door with a cylindrical bore into which the mounting cup is inserted.

Referring to the FIG. 1, the preferred embodiment of a cabinet hinge 10 is shown. Hinge 10 is used to mount a substantially solid cabinet door 20 for selective pivotal movement between an opened position and a closed position with respect to a frame. In the embodiments shown in the FIGURES, cabinet door 20 is of an overlay type, as is described in U.S. Pat. No. 5,355,557 (entitled "CONCEALED SELF-CLOSING HINGE WITH INTEGRAL HINGE PIN MEANS") issued to Cress et al. on Oct. 18, 1994, incorporated by reference herein. Door 20 is shown in cut-away as made of wood, with visible wood grain (although any other material suitable for such purposes, such as metal or plastic could be used).

Figure 3:
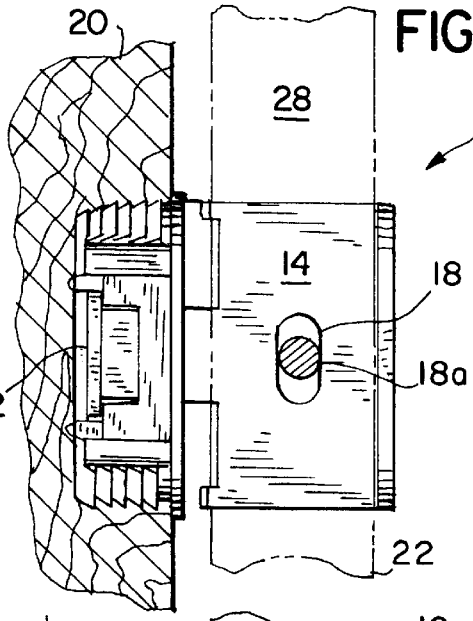
FIG. 3 is a side and cut-away view of the cabinet hinge when mounted in the cabinet door (shown in cut-away) and to the frame.
Figure 4:
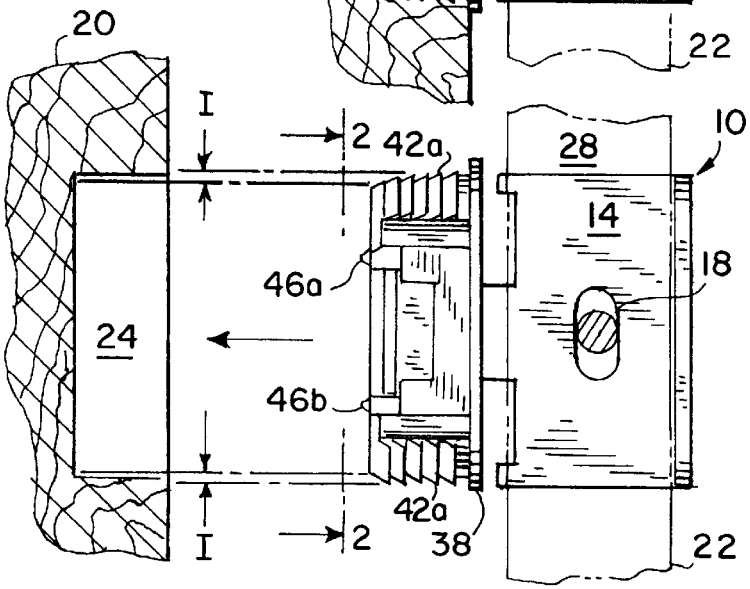
FIG. 4 is a side and cut-away view of the cabinet hinge before mounting in the cabinet door (shown in cut-away) and to the frame.

Referring to FIG. 1, hinge 10 includes a mounting cup 30 pivotally coupled to a frame member 12 by a hinge mechanism 32. According to the preferred embodiment, mounting cup 30 is adapted to be mounted within a cylindrical bore or recess (shown as reference numeral 24 in FIG. 1) in the inner surface 26 of door 20; frame member 12 is adapted to be mounted to an edge 28 (shown in FIGS. 3 and 4) of frame 22. Cylindrical bore 24 has a substantially cylindrical inner perimeter wall 24*a*, which is created when bore 20 is formed in the door. (According to the preferred embodiment, the cylindrical bore or recess is formed in the inner surface of the door in order to conceal the hinge from view from the front of the cabinet, in what is commonly known in the art as "concealed" hinge.)

In all of the disclosed embodiments shown in the FIGURES, frame member 12 includes a substantially flat frame wing 14 (which is mounted to frame 22) and a curved hinge arm 16, through which the frame member is pivotally coupled to mounting cup 30. In any particularly preferred embodiments, the frame member is of the same general arrangement as is shown in U.S. Pat. No. 5,355,557, which has been incorporated by reference herein. In the particularly preferred embodiments shown in the FIGURES, frame member 12 is formed as an integral assembly in a sheet metal stamping operation. Frame wing 14 is mounted against edge 28 of frame 22 fastened by a screw or like fastener (e.g. as shown by reference numeral 18*a* in FIG. 16) extending through a vertically elongated slot 18 in frame wing 14 into a hole (not shown) in edge 28. (The vertically elongated slot allows adjustment of the vertical position of the cabinet door with respect to the frame.) When so mounted, frame 22 is positioned within frame member 12 between integrally formed flange 15 and two integrally-formed tabs 16*a* and 16*b*. Integrally-formed hinge arm 16 extends laterally and outwardly away from the edge 28 of frame 22 in an outwardly-spaced relation allowing selective pivotal movement of door 20 with respect to frame 22 in a range defining an opened position and a closed position. In any alternative embodiments (not shown), the frame member can be of other suitable arrangements known to those of ordinary skill in the art.

In any particularly preferred embodiment, the pivotal coupling of the frame member to the mounting cup is effected with a hinge mechanism as is shown in U.S. Pat. No. 5,355,557 (i.e. a self-closing mechanism), which has been incorporated by reference herein (and is shown in the FIGURES). In any alternative embodiments, any other known hinge mechanisms, for example, such as shown in U.S. Pat. No. 4,716,622 issued to DeBruyn on Jan. 5, 1988, and U.S. Pat. No. 5,027,474 issued to Bowers on Jul. 2, 1991, which are also incorporated by reference herein, can be employed to effect the suitable pivotal coupling of the mounting cup to the frame member.

Figure 1A:
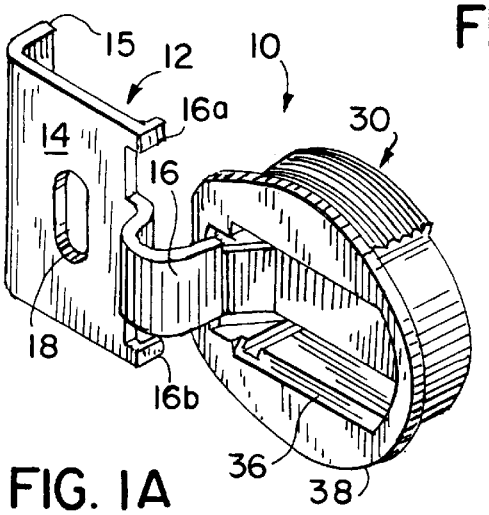
FIG. 1A is a perspective view of the cabinet hinge showing the frame member in an open position with respect to the mounting cup.
Figure 2:
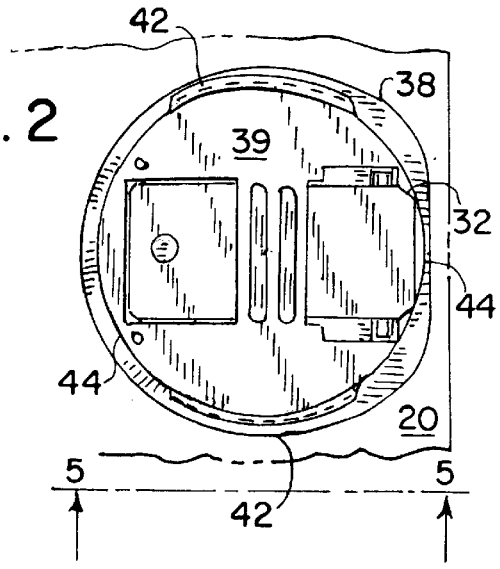
FIG. 2 is a bottom plan view of the cabinet hinge of FIG. 1.
Figure 5:
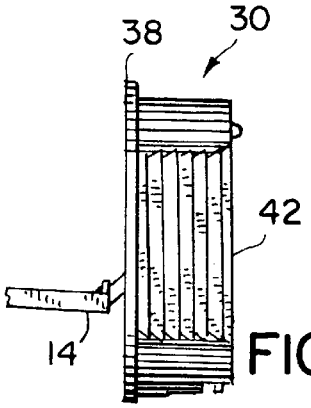
FIG. 5 is a side view of the cabinet hinge (with the frame member arm in cut-away view)

As in the FIG. 1, mounting cup 30 is formed as an integral assembly with a substantially rigid, substantially continuous outer perimeter (wall) 40 and a substantially orthogonal inner recess 36, within which is contained the components of the hinge mechanism (of which only a portion are visible in the FIGURES and which are more fully described in U.S. Pat. No. 5,355,557), and within which is received a substantial portion of hinge arm 16 when the hinge is in the closed position. (The hinge is shown in the opened position in FIG. 1A.) A flange (shown as substantially circular flange 38, although other shapes may be used) extends around and transversely from the open end of recess 36 within mounting cup 30. Cup 30 also has a substantially rigid bottom surface 39. According to the preferred embodiment, mounting cup 30 is formed from a die cast metal, such as zinc. In alternative embodiments, the mounting cup can be made of other materials, such as steel or other metals, or of a plastic of sufficient strength (reinforced as necessary).

As shown in the FIGURES (other than FIGS. 15 and 16), substantially continuous outer perimeter 40 of mounting cup 30 has a first portion with a plurality of raised threaded arcuate sections (identified by reference numeral 42) and a second portion with a plurality of unthreaded (but not necessarily arcuate) sections (identified generally by reference numeral 44). As shown, the raised threaded arcuate sections have a greater effective outer diameter than the unthreaded sections. (The "effective diameter" of each section is the distance across the cup at the respective section.) Each threaded section has a circumferential thread pattern that partially encircles outer perimeter 40 of mounting cup 30, the thread pattern not extending into the adjacent unthreaded sections. This forms a discontinuous thread pattern about outer perimeter 40 of mounting cup 30, a portion of which is threaded or ribbed and a portion of which is unthreaded. In any preferred embodiment, the raised threaded arcuate sections and unthreaded sections are positioned with respect to one another about the outer perimeter of the mounted cup to provide what is called herein a discontinuous threaded arrangement.

Referring to FIGS. 1 through 5, discontinuous threaded mounting cup 30 is shown with a pair of raised threaded substantially arcuate sections 42 having threads (shown typically with reference numeral 42*a*) and two unthreaded sections 44, which are also substantially arcuate and, in any event are not raised to the level (i.e. outer diameter) of the threaded sections. (This basic arrangement of the threaded portion and unthreaded portion of outer perimeter 40 is also shown in FIGS. 17 through 26.)

In the alternative embodiment shown in FIGS. 6 through 10, discontinuous threaded mounting cup 30 has three raised arcuate threaded sections (designated by reference numeral 42); mounting cup 30 also has five unthreaded sections, one of which (designated by reference numeral 44*a*) is substantially arcuate in shape (to accommodate the hinge mechanism) and four of which are formed as separate cutouts (designated by reference numeral 44*b*) from the outer perimeter of mounting cup 30. In the alternative embodiment shown in FIGS. 11 through 14, discontinuous threaded mounting cup 30 has five raised arcuate threaded sections (designated by reference numeral 42); mounting cup 30 also has five unthreaded sections (designated by reference numeral 44), each of which is also substantially arcuate in shape. These alternative embodiments are intended only to demonstrate the wide variety of discontinuous threaded arrangements within the scope of the present invention. In the alternative embodiment shown in FIGS. 15, mounting cup has a substantially continuous ribbed section (with ribs shown as reference numeral 42*c*).

In the preferred embodiments, mounting cup 30 is adapted to be pressed into an interference fit within cylindrical bore 24 of door 20. Accordingly, the diameter of cylindrical bore 24 is slightly less than the outer diameter (e.g. nominal thread diameter) of the raised threaded arcuate sections of mounting cup 30, creating an interference fit (indicated in FIG. 4 with the reference letter I) between the mating surfaces of the cup and the bore (i.e. the perimeter wall of the bore and the raised threaded sections of the cup) and requiring that a corresponding interference force (i.e. "press-in" force) be overcome to press cup 30 into bore 24. The interference also results in the secure and positive retention of cup 30 within bore 24, and a mounting arrangement that is capable of withstanding a certain level of "pull-out" force regardless of the typical variations in the size and shape of bore 30 that may result from environmental (temperature and moisture) effects or in assembly. (For example, in a particularly preferred embodiment, the diameter of the bore is 35 millimeters and the nominal diameter of the raised threaded arcuate sections of the mounting cup is 36 millimeters, which develops an interference between the cup and bore in a typical range of between 0.015 to 0.045 inches.) In the preferred embodiments, the interference provides the substantial entirety of the holding force between the hinge and the door (i.e. without other securing devices).

According to the preferred embodiments, the diameter of the cylindrical bore is slightly greater than the outer diameter of the unthreaded sections of mounting cup 30 (i.e. about the outer perimeter) assuring that there is a clearance (i.e. no interference) or in any event minimal interference between those surfaces. (Accordingly, the maximum outer diameter of the threaded section is also greater than the nominal outer diameter of the unthreaded section.)

When mounting cup 30 has been fully pressed into cylindrical bore 24, the underside of flange 38 rests upon or near the inner surface of the door. Referring back to FIGS. 3 and 4, a pair of spurs 46*a* and 46*b* are shown extending in an axial direction from the bottom of mounting cup 30; spurs 46*a* and 46*b* press into the bottom surface of cylindrical bore 24 to provide additional resistance (e.g. to rotational movement) when cup 30 has been fully mounted; these spurs are not necessary where such additional resistance is not necessary. (Any other such retaining elements known in the art can also be used.)

By adapting the design of the threaded and unthreaded sections, the amount of interference force between the surface of the cylindrical bore and the raised threaded sections of the mounting cup can be adjusted to a desired level within a range for the particular installation. In practice, both the "press-in" force (i.e. the force required to press the cup into the bore) and the "pull-out" force (i.e. the force required to pull the cup from the bore) should be considered. In a wood cabinet door, it is desirable to develop interference forces in the proper direction with respect to the wood grain to minimize cross-granular (i.e. "across the grain") forces applied to the bore. In commonly encountered applications, a reasonable level of press-in force is typically in a range of 100 to 500 pounds. (This is within a range that can be generated by commonly-available inserting equipment.) It is also desirable to maintain adequate pull-out (hold-in) strength for the application.

The percentage of surface area of threaded portion to surface area of unthreaded portion (or overall circumferential surface area) is a factor allowing the press-in and pull-out forces to be adjusted within a range to suitable levels. For example, in the preferred embodiment shown in FIGS. 1 through 5, the two threaded sections each cover approximately 60 degrees of the outer perimeter, or 120 degrees total or 33.3 percent of the total circumference (360 degrees) of the outer perimeter of the mounting cup. In the three-section embodiment (shown in FIGS. 6 through 10), the coverage of the threaded sections is 41.7 percent of the total circumference (45 degrees+45 degrees+60 degrees=150 degrees). FIGS. 11 through 12 show the five-section embodiment, in which there is also 41.7 percent total circumferential coverage (30 degrees×5=150 degrees) of the threaded sections. These embodiments have been found to provide suitable press-in and pull-out forces in particular applications, as would other similar combinations of number of sections and percentage of circumference. For example, in the preferred embodiments, a total circumferential coverage within a range of 25 to 50 percent has also demonstrated suitable performance. A lower percentage of coverage of the threaded sections tends to reduce the pull-out force or "bend-back" strength to an unacceptably low level. ("Bend-back" strength is the ability of the door to withstand pivotal movement beyond the opened position, i.e. "over opening".) Using a higher percent of total coverage by the threaded sections may increase the press-in (insertion) force to an unacceptably high level, which may result in damage to the door (i.e. to the bore) or exceed the capability of the insertion tool.) In alternative embodiments, the threaded sections can cover from 20 to 90 percent of the circumferential surface of the outer perimeter of the mounting cup. (These criteria also apply in alternative embodiments employing circumferential ribs instead of threads.) The appropriate amount of circumferential coverage of the threaded portion of the outer perimeter will depend upon the arrangement and dimension of the threads (or ribs) in that portion, and degree of interference provided therein.

The relative and overall positioning of the threaded sections is also a factor for consideration. It is beneficial to have a substantial portion of threads perpendicular to the wood grain. For example, in the preferred embodiment shown in FIGS. 1 through 5, the threaded sections are each substantially entirely oriented in a direction perpendicular to the wood grain. Having the threaded sections at the top and bottom of the mounting cup (i.e. "across the grain," as shown in the preferred embodiment) serves to resist the effects of "overopening" and also to resist the effects of dimensional changes in the bore caused by temperature and moisture (e.g. humidity). (A bore in a wood door would typically elongate in the direction parallel to the grain as moisture content increases.) In addition, by orienting the threaded sections in a symmetrical pattern, the mounting cup is more likely to be properly "centered" when it is pressed into the bore. This also serves to "balance" the mounting cup within the bore. (These criteria also apply in alternative embodiments employing circumferential ribs instead of threads.)

The interference fit of the cup within the bore can also be adjusted by making adjustments to the dimensions of the threads (or ribs). The use of buttress or unidirectional threads in the threaded sections of the outer perimeter of the mounting cup permits efficient insertion (press-in) to the bore, positive retention, and also for efficient removal by unscrewing the mounting cup from the bore. (In the preferred embodiment, the pitch is 16 threads per inch.) The shallow angle on the bottom of the threads (e.g. 60 degrees) provides a leveraging effect during press-in. The relatively flat top of the thread (.e.g. the "sharp" edge given to the thread profile) holds the mounting cup securely within the bore and provides suitable resistance to pull-out forces. In alternative embodiments, any of a variety of other thread arrangements can be employed. For example, a double-thread lead can be employed to facilitate rapid removal (i.e. unthreading) of the mounting cup from the bore. In other alternative embodiments, circumferential ribs (or spines)

can be used in the raised arcuate sections (instead of threads), which will provide suitable and comparable interference forces but will not facilitate removal by unthreading the mounting cup.

Figure 15:
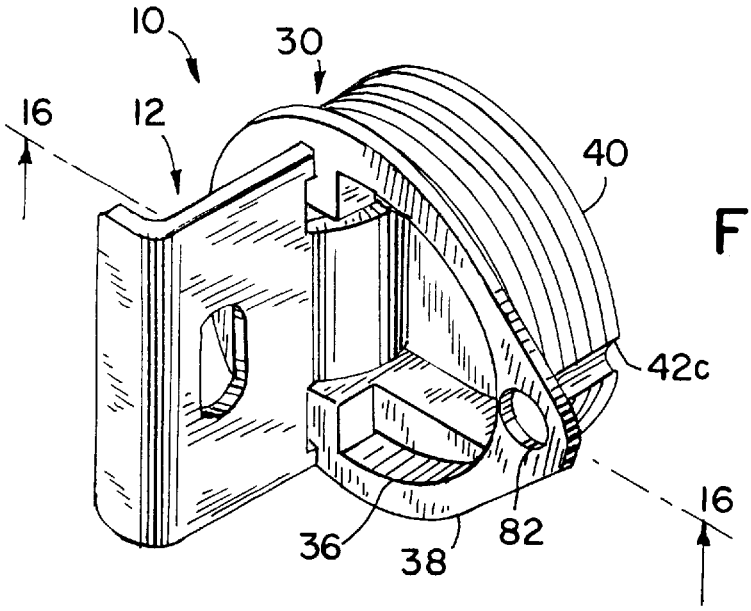
FIG. 15 is a perspective view of a cabinet hinge according to an alternative embodiment having an additional mounting screw to secure the mounting cup to the door.
Figure 16:
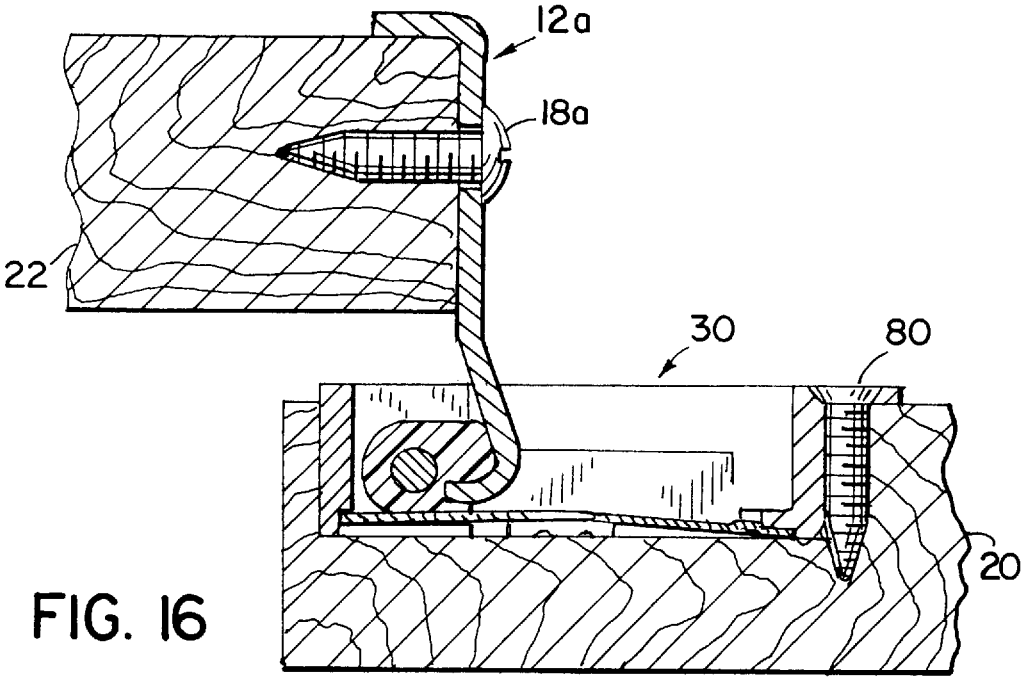
FIG. 16 is a side and cut-away view of the cabinet hinge according to an alternative embodiment having an additional mounting screw to secure the mounting cup to the door.
Figure 23:
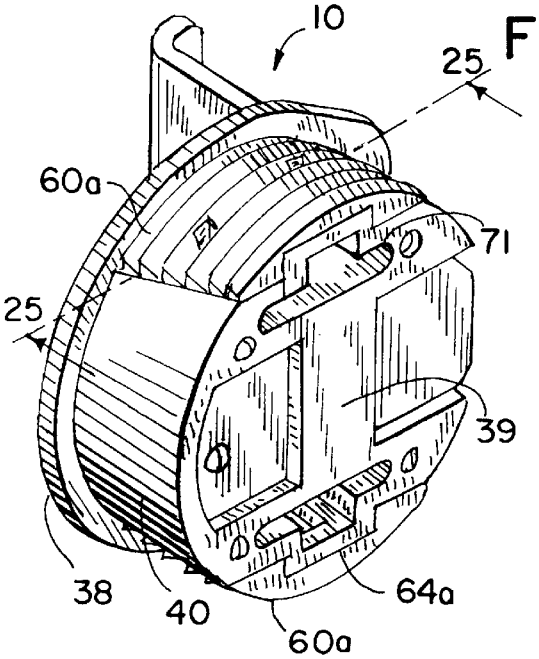
FIG. 23 is a perspective rear view of the cabinet hinge according to an alternative embodiment showing two removable threaded wedges removed from the outer perimeter of the mounting cup.
Figure 24:
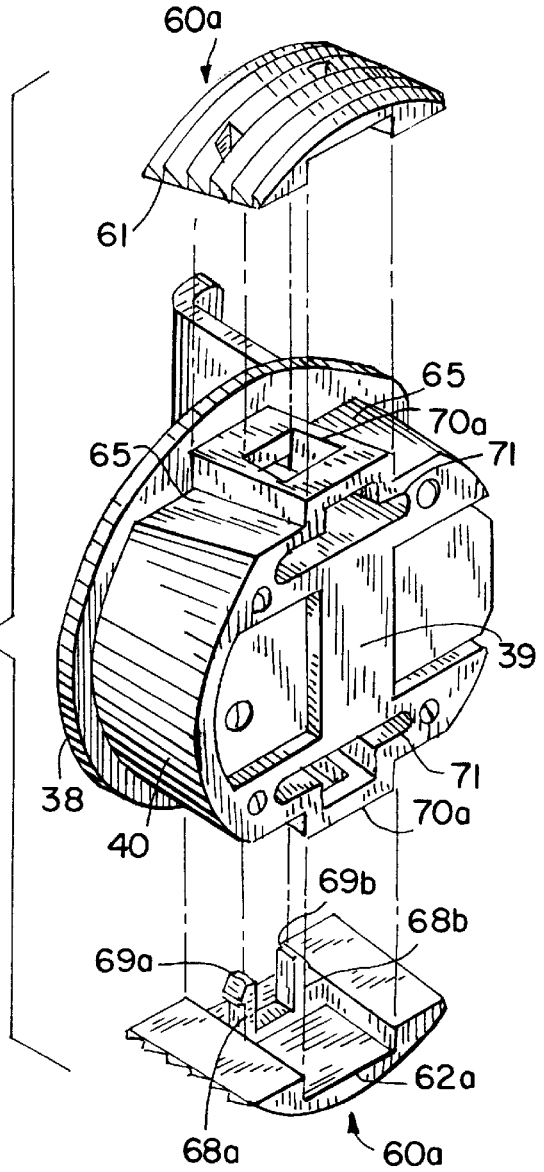
FIG. 24 is a perspective rear view of the cabinet hinge of FIG. 23 showing a coupling of the removable threaded wedge with the outer perimeter of the mounting cup.
Figure 26:
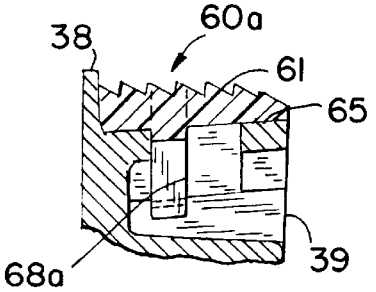
FIG. 26 is a side view of the removable threaded wedge.
Figure 25:
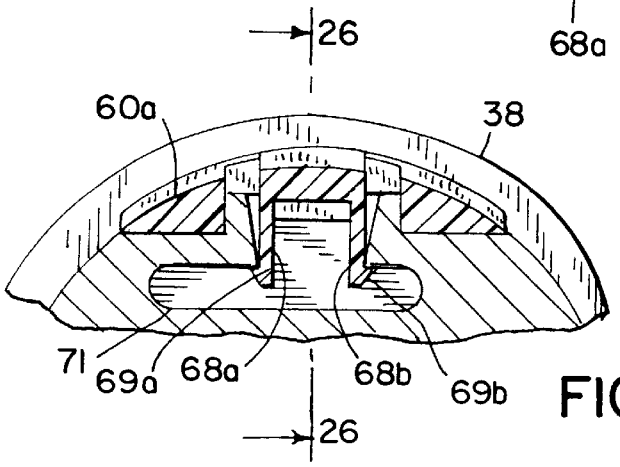
FIG. 25 is a sectional and end view of the cabinet hinge of FIG. 23 showing the outer perimeter of the mounting cup at the coupling to a removable threaded wedge.

According to the alternative embodiments shown in FIGS. 15 and 16, mounting cup 30 can be fastened to door 20 with a fastening screw 80 that extends through a mounting hole 82 extending from flange 38, thereby further securing hinge 10 to door 20. The alternative embodiment of FIG. 15 shows substantially continuous ribs instead of discontinuous threads, but could also be used with the discontinuous threaded arrangement. (The alternative embodiment of FIG. 16 also shows an alternative arrangement of the frame member 12*a* and hinge mechanism.) In other alternative embodiments (not shown), a plurality of fastening screws (each with a corresponding mounting hole) can be used to secure the mounting cup to the door. Other alternative embodiments (not shown) may employ means to ensure that the mounting cup remains securely mounted within the bore under such environmental conditions such as high humidity and when the cabinet door is subjected to unusual "bend back" (or impact) loads. In an alternative embodiment (not shown), an adhesive could be applied (or pre-applied) which is activated or takes effect upon insertion of the cup into the bore.

In the alternative embodiment shown in FIGS. 13 and 14, hinge 10 also includes an outer collar (shown as outer cup 50, made of a suitably compliant and resilient material such as plastic or the like), which is fit onto mounting cup 30 forming an assembly which is then press-fit into the cylindrical bore. Outer cup 50 is shown with circumferential inner ribs 50*a* and outer ribs 50*b* (although inner or outer ribs may not be employed in alternative embodiments.) According to this alternative embodiment, enhanced holding forces may be attained and additional protection may be achieved for the integrity of bore 24 (which may under certain circumstances split or crack or otherwise suffer damage) during the insertion and removal of the mounting cup. In alternative embodiments (not shown), a compliant ring can be used instead of a cup. In other alternative embodiments (not shown), the outer perimeter of the compliant ring can include discontinuous threaded (or ribbed) sections. In alternative embodiments, this compliant cup or ring can be used to enhance the possibility of secure mounting in a damaged bore.

In a particularly preferred alternative embodiment shown in FIGS. 17 through 26, outer perimeter 40 includes a substantially flat wall 65 angled to provide a smaller effective outer diameter at the inner portion (i.e. nearest to flange 38) than at the outer portion (i.e. adjacent to the bottom surface 39). Referring to FIG. 19, segments, shown as removable arcuate wedges (identified with reference numeral 60 with threads shown typically as reference numeral 61), couple to wall 65 of outer perimeter 40 to provide the raised threaded arcuate sections of mounting cup 30. As shown more clearly in FIG. 20, each wedge 60 includes a central slot 62 which is slidably received a corresponding rib 64 extending from wall 65 of mounting cup 30 in a tongue-and-groove arrangement. A preferred embodiment of this arrangement is shown more clearly in FIGS. 21 and 22, which reveals the angled shape of rib 64 and corresponding slot 62. Outer perimeter of mounting cup also includes unthreaded sections 44.

In the preferred embodiments, wedges 60 are formed from a compliant (durable and resilient) plastic material (e.g. acetal, "DELRIN", or the like) and have a bottom ledge 66 (which may rest on the bottom surface 39 of mounting cup 30 as shown in FIG. 20) and angled sides (as shown in FIG. 22). As shown in FIGS. 21 and 22, rib 64 and slot 62 of the tongue-and-groove mating arrangement between the wedges and the outer perimeter of mounting cup 30 has an angled profile. The upper edge of each wedge can be adapted to rest on the underside of flange 38. In alternative embodiments, the wedges can be formed from other materials (including elastomers, nylon, metal or wood or the like). In alternative embodiments, any suitable number of threaded (or ribbed) segments can be used to provide an appropriate interference fit.

According to this embodiment, as in the other disclosed embodiments, cup 30 is pressed into an interference fit within the cylindrical bore of the door 20. The diameter of bore 24 is slightly less than the outer diameter of the raised threaded arcuate sections (wedges 60), which are themselves formed with an angled profile that inversely correlates to the angled profile of outer perimeter 40 of mounting cup 30 (and therefore presents a raised arcuate threaded section that is oriented in substantial vertically alignment with the inner diameter of the cylindrical bore in the door). The use of a resilient plastic material for the wedges reduces the press-in force required for inserting the mounting cup into the bore. For a given area of threaded section, this angled-profile arrangement provides enhanced resistance to pull-out forces (i.e. forces in an axial or outward direction with respect to the bore) that may be applied to mounting cup 30. As a pull-out force is applied, the angled profile of the wedge is guided along the angled profile of outer perimeter 40 of mounting cup 30, which tends to enlarge the total effective outer diameter of the cup, thereby increasing the interference force tending to retain the cup in the bore. As a result of this interaction of angled profiles, the cup is secured in the bore when subjected to pull-out forces. In other alternative embodiments any other arrangement known to provide this holding effect can be employed.

According to alternative embodiments, the removable wedges can be adapted to fasten to the outer perimeter of the mounting cup by other methods, such as a snap-fit or quick attachment. For example, in the embodiment shown in FIGS. 23 through 26, each wedge 60*a* includes a central slot 62*a* and extensions 68*a* and 68*b*. Extensions 68*a* and 68*b* are received within an aperture 70*a* in a rib 64*a* which protrudes from a flat wall 65*a* of outer perimeter 40 of cup 30. (In a particularly preferred embodiment, the extensions are integrally formed of the material of the wedge.) Extensions 68*a* and 68*b* include latching tabs 69*a* and 69*b* that are displaced outwardly once placed within corresponding aperture 70*a* and serve to retain wedge 60*a* for slidable movement with respect to outer perimeter in an axial (or outward) direction. The cooperation of the angled profiles of wedge 60*a* and wall 65*a* during slidable movement provides the holding effect described previously. Access hole 71 formed in the bottom surface 39 of mounting cup 30 allows the inward displacement of extensions 68*a* and 68*b* to release tabs 69*a* and 69*b* for removal of wedge 60*a*.

In an alternative embodiment (not shown), the mounting cup can include a position indicator (e.g. a dot, slot, notch, flat, marking or the like), preferably on the outer surface of the flange, that shows the rotational position of the mounting cup with respect to a reference indicator corresponding to the edge of the door (e.g. a dot, slot, notch, marking, edge of the door itself, or the like) at or near the cylindrical bore. This position indicator allows the verification of the orientation of the mounting cup within the bore.

In any preferred embodiment of the threaded mounting cup, the cup can be unthreaded from the bore by circular rotation, which can be facilitated by a tool which may interface with the inner recess or other exposed surface of the mounting cup.

It will be understood that the foregoing descriptions of preferred and alternative embodiments of the invention do not limit the scope of the invention to the specific embodiments shown. The present invention can be readily adapted for any other applications where it is desired to have a press-in cup that can be removed by unthreading, and is not limited in application to cabinet hinges. Other modifications may be made in the design and arrangement of the elements without departing from the scope of the invention as expressed in the appended claims.

We claim:

1. A hinge for mounting a door with a wood grain to a frame, which comprises:

(a) a mounting cup having a substantially rigid and substantially continuous outer perimeter adapted for mounting within a recess formed in the door;

(b) a hinge member for being mounted to the frame and coupled to the mounting cup to allow selective pivotal movement of the door with respect to the frame; and wherein the outer perimeter of the mounting cup includes a first portion having a first effective outer diameter and a second portion having a second effective outer diameter, the first outer diameter being larger than the second outer diameter, the first portion providing for an interference fit within the recess when the mounting cup is inserted into the recess, the interference fit to provide substantially all holding force between the hinge and the outer door;

further wherein the first portion of the outer perimeter includes circumferential threads oriented to allow the mounting cup to be selectively and rotatably removed from the recess and further wherein the second portion of the outer perimeter does not include circumferential threads, the first portion being positioned such that the circumferential threads are substantially perpendicular to the wood grain of the door.

2. The hinge of claim 1 wherein the first portion of the outer perimeter comprises at least one threaded section and the second portion comprises at least one unthreaded section.

3. The hinge of claim 1 wherein the first portion of the outer perimeter comprises a plurality of arcuate threaded sections and the second portion of the outer perimeter comprises a plurality of unthreaded sections, the arcuate threaded sections and the unthreaded sections being arranged about the outer perimeter in a discontinuous threaded pattern.

4. The hinge of claim 1 wherein the first portion of the outer perimeter occupies a fixed percentage of the outer perimeter.

5. The hinge of claim 1 wherein the first portion of the outer perimeter occupies a percentage of the outer perimeter in a range from about 20 percent to about 90 percent.

6. The hinge of claim 1 wherein the first portion of the outer perimeter occupies a percentage of the outer perimeter in a range from about 25 percent to 50 percent.

7. A hinge for mounting a door with a wood grain to a frame, which comprises:

(a) a mounting cup having a substantially rigid and substantially continuous outer perimeter adapted for mounting within a recess formed in the door;

(b) a hinge member for being mounted to the frame;

(c) a hinge mechanism pivotally coupling the mounting cup to the hinge member to allow selective pivotal movement of the door with respect to the frame; and wherein the outer perimeter or the mounting cup includes a first portion having a first effective outer diameter and a second portion having a second effective outer diameter, the first outer diameter being larger than the second outer diameter, the first portion providing for an interference fit within the recess when the mounting cup is inserted into the recess, the interference fit to provide substantially all holding force between the hinge and the outer door; further wherein the first portion of the outer perimeter includes circumferential threads oriented to allow the mounting cup to be selectively and rotatably removed from the recess, the first portion being positioned such that the circumferential threads are substantially perpendicular to the wood grain of the door and wherein the interference fit is substantially greater than interference fit provided by mounting cups with only one portion of the outer perimeter of the mounting cup.

8. The hinge of claim 7 wherein the first portion of the outer perimeter comprises a plurality of threaded sections and the second portion of the outer perimeter comprises a plurality of unthreaded sections, the threaded sections and the unthreaded sections being arranged about the outer perimeter in a discontinuous threaded pattern.

9. The hinge of claim 7 wherein the first portion of the outer perimeter comprises a first threaded section and a second threaded section, the first threaded section being centered about 180 degrees from the second threaded section.

10. The hinge of claim 9 wherein the first threaded section and the second threaded section are adapted to provide the interference fit across a wood grain in the door.

11. The hinge of claim 7 wherein the mounting cup is formed from a die cast metal.

12. The hinge of claim 7 wherein the mounting cup is formed from a plastic material.

13. The hinge of claim 7 further comprising spur means for securing the mounting cup to the recess.

14. A hinge for mounting a door with a wood grain to a frame, which comprises:

(a) a mounting cup having a substantially rigid outer perimeter adapted for mounting within a recess formed in the door;

(b) a hinge member for being mounted to the frame and coupled to the mounting cup to allow selective pivotal movement of the door with respect to the frame; and wherein the outer perimeter of the mounting cup includes a first portion having a first effective outer diameter and a second portion having a second effective outer diameter, the first outer diameter being larger than the second outer diameter, the first portion being providing for an interference fit within the recess when the mounting cup is inserted into the recess, the interference fit to provide substantially all holding force between the hinge and the outer door, and further wherein the first portion of the outer perimeter comprises a plurality of arcuate threaded sections and the second portion of the outer perimeter comprises a plurality of unthreaded sections, the arcuate threaded sections and the unthreaded sections being arranged about the outer perimeter in a discontinuous threaded pattern, the arcuate threaded sections disposed symmetrically around the outer perimeter of the mounting cup, the first portion being positioned such that the arcuate threads are substantially perpendicular to the wood grain of the door.

15. The hinge of claim 14 wherein the first portion of the outer perimeter occupies a fixed percentage of the outer perimeter, wherein the fixed percentage is in a range from about 30 percent to 90 percent.

16. The hinge of claim 13 wherein the second portion of the outer perimeter includes at least one cutout.

17. A hinge for mounting a door with a wood grain to a frame, which comprises:

(a) a mounting cup having a substantially rigid and substantially continuous outer wall for insertion within a recess formed in the door;

(b) a hinge member for mounting to the frame and for coupling to the mounting cup to allow selective pivotal movement of the door with respect to the frame; and wherein the outer wall includes a first portion having a first effective outer diameter and a second portion having a second effective outer diameter, the first effective outer diameter being larger than the second effective outer diameter; wherein the first diameter provides for an interference fit with the recess formed in the door, the interference fit sufficient to provide substantially the entire holding force between the hinge and the door; and wherein the first portion of the outer wall includes circumferential threads oriented to allow the mounting cup to be selectively and rotatably removed from the recess, the first portion being positioned such that the circumferential threads are substantially perpendicular to the wood grain of the door.

18. A hinge for mounting a door with a wood grain to a frame, which comprises:

(a) a mounting cup having a substantially rigid and substantially continuous outer wall for insertion within a recess formed in the door;

(b) a hinge member for mounting to the frame and for coupling to the mounting cup to allow selective pivotal movement of the door with respect to the frame; and wherein the outer wall includes a first portion having a first effective outer diameter and a second portion having a second effective outer diameter, the first effective outer diameter being larger than the second effective outer diameter; wherein the first diameter provides for an interference fit with the recess formed in the door, the interference fit sufficient to provide substantially the entire holding force between the hinge and the door; wherein the first portion of the outer wall comprises a plurality of arcuate threaded sections and the second portion of the outer wall comprises a plurality of unthreaded sections, the arcuate threaded sections and the unthreaded sections being arranged about the outer wall in a discontinuous threaded pattern, and further wherein the arcuate threaded sections are disposed symmetrically around the outer wall of the mounting cup, the first portion being positioned such that the arcuate threads are substantially perpendicular to the wood grain of the door.

19. A hinge for mounting a door with a wood grain to a frame, which comprises:

(a) a mounting cup having a substantially rigid and substantially continuous outer wall for insertion within a recess formed in the door;

(b) a hinge member for mounting to the frame and for coupling to the mounting cup to allow selective pivotal movement of the door with respect to the frame; and wherein the outer wall includes a first portion having a first effective outer diameter and a second portion having a second effective outer diameter, the first effective outer diameter being larger than the second effective outer diameter; and wherein the first diameter provides an interference fit to couple the mounting cup in the recess formed in the door, the interference fit is sufficient to provide substantially the entire holding force between the hinge and the door, the first portion being positioned such that the interference fit is substantially perpendicular to the wood grain of the door.

20. The hinge of claim 19 wherein the first portion of the outer wall comprises at least one threaded section and the second portion comprises at least one unthreaded section.

* * * * *